US008022637B2

(12) United States Patent
Feldtkeller et al.

(10) Patent No.: US 8,022,637 B2
(45) **Date of Patent: *Sep. 20, 2011**

(54) METHOD FOR DETECTION OF NON-ZERO-VOLTAGE SWITCHING OPERATION OF A BALLAST OF FLUORESCENT LAMPS, AND BALLAST

(75) Inventors: Martin Feldtkeller, Munich (DE); Antoine Fery, Munich (DE); Michael Herfurth, Gilching (DE)

(73) Assignee: Infineon Technologies AG, Munich (DE)

( * ) Notice: Subject to any disclaimer, the term of this patent is extended or adjusted under 35 U.S.C. 154(b) by 111 days.

This patent is subject to a terminal disclaimer.

(21) Appl. No.: 12/381,648

(22) Filed: Mar. 13, 2009

(65) Prior Publication Data

US 2009/0256487 A1 Oct. 15, 2009

Related U.S. Application Data

(62) Division of application No. 11/195,370, filed on Aug. 2, 2005, now Pat. No. 7,560,873.

(30) Foreign Application Priority Data

Aug. 2, 2004 (DE) ..... 10 2004 037 388

(51) Int. Cl.
*H05B 41/36* (2006.01)
*G05F 1/00* (2006.01)

(52) U.S. Cl. ..... 315/224; 315/291

(58) Field of Classification Search ..... 315/224, 315/291, 307, 209 R, 306, 308, 309, 310, 315/311

See application file for complete search history.

(56) References Cited

U.S. PATENT DOCUMENTS 5,914,572 A * 6/1999 Qian et al. ..... 315/307
5,973,943 A 10/1999 Ribarich et al.
6,008,592 A * 12/1999 Ribarich ..... 315/225
6,031,342 A 2/2000 Ribarich et al.

(Continued)

FOREIGN PATENT DOCUMENTS

EP 1066739 B1 2/2002

OTHER PUBLICATIONS

Data Sheet No. PD60182-I, International Rectifier, pp. 1-23, www.irf.com, California.

(Continued)

*Primary Examiner* — Douglas W Owens
*Assistant Examiner* — Minh D A
(74) *Attorney, Agent, or Firm* — Maginot, Moore & Beck

(57) ABSTRACT

A method detects a non-zero-voltage switching operation of a lamp ballast, the lamp ballast including a half-bridge circuit with a first and a second semiconductor switching element, a resonant circuit connected to the half-bridge circuit, and a snubber capacitance connected in parallel with one of the semiconductor switching elements. The method includes obtaining a voltage measurement signal representative of a voltage at an output of the half-bridge circuit. The method also includes providing a comparison signal representative of a comparison of the voltage measurement signal with a reference value. The method further includes evaluating the comparison signal in each case before the first semiconductor element is switched on and in each case before the second semiconductor element is switched on, and detecting one of a first and second non-zero-switching operations based on these evaluations.

13 Claims, 10 Drawing Sheets

U.S. PATENT DOCUMENTS

| | | | | |
|---|---|---|---|---|
| 6,331,755 | B1 | 12/2001 | Ribarich et al. | |
| 6,362,575 | B1 * | 3/2002 | Chang et al. | 315/224 |
| 6,396,250 | B1 * | 5/2002 | Bridge | 323/283 |
| 6,400,095 | B1 | 6/2002 | Primisser et al. | |
| 6,466,456 | B2 | 10/2002 | Sauerlaender et al. | |
| 6,590,351 | B2 * | 7/2003 | Huber | 315/291 |
| 6,617,805 | B2 | 9/2003 | Ribarich et al. | |
| 6,936,973 | B2 * | 8/2005 | Parra et al. | 315/209 R |
| 7,560,873 | B2 * | 7/2009 | Feldtkeller et al. | 315/224 |
| 2004/0007992 | A1 | 1/2004 | Ribarich | |

OTHER PUBLICATIONS

Contenti, Cecilia, "Reference Design: IRPLMB1E-25W 230VAC small size ballast using IR2520D," International Rectifier, Mar. 14, 2004, www.irf.com.

Schoofs, Frans and Carmen Dupont. "A 700-V Interface IC for Power Bridge Circuits." IEEE Journal of Solid-State Circuits, Jun. 1990, pp. 677-683, vol. 25, No. 3.

Data Sheet No. PD60212, "IR2520D(S): Adaptive Ballast Control IC," International Rectifier, 2004, pp. 1-10, www.irf.com.

* cited by examiner

METHOD FOR DETECTION OF NON-ZERO-VOLTAGE SWITCHING OPERATION OF A BALLAST OF FLUORESCENT LAMPS, AND BALLAST

This application is a division of U.S. patent application Ser. No. 11/195,370, now U.S. Pat. No. 7,560,873, filed Aug. 2, 2005.

FIELD OF THE INVENTION

The present invention relates to a method for detection of the operating state, in particular of non-zero-voltage switching operation, of a ballast for florescent lamps, and to a ballast.

BACKGROUND

In order to assist understanding of the invention as explained in the following text, the fundamental design of an electronic ballast, which is used to drive a florescent lamp, and its method of operation will first of all be explained with reference to FIGS. 1 and 2. A ballast such as this is described, by way of example, in EP 1 066 739 B1, U.S. Pat. No. 6,617,805 B2 or in the Data Sheet No. PD 60182-I for the IR2156(S) integrated module produced by International Rectifier, California, USA.

An electronic ballast has a half-bridge with two semiconductor switching elements Q1, Q2, whose load paths are connected in series between supply terminals K1, K2, between which a DC voltage Vb is applied. These two semiconductor switching elements S1, S2 are driven via a drive circuit 20 which drives each of the two semiconductor switching elements S1, S2 in a clocked form. The two semiconductor switches Q1, Q2 are in this case driven alternately in order to ensure that the two semiconductor switches are never switched on at the same time. A voltage V2, which has an essential square waveform, is produced at an output K3 of the half-bridge, which is formed by a node that is common to the load paths of the semiconductor switching elements.

This voltage V2 feeds a resonant tuned circuit with a resonant inductance L1 and a resonant capacitor C1, with a florescent lamp being connected in parallel with the resonant capacitor C1 in the example. A further capacitor C2, which is connected in series with the resonant inductance L1 and upstream of the parallel circuit formed by the florescent lamp 10 and the resonant capacitor C1, is used as a blocking capacitor, and blocks direct-current components.

A snubber capacitor C3 is connected in parallel with the load path of the second semiconductor switching element Q2, with the object of reducing the switching losses during zero-voltage switching operation (ZVS) of the two semiconductor switching elements Q1, Q2.

The illustration does not show the normally provided measurement connections of the drive circuit 20, via which by way of example a voltage across the florescent lamp 10 or a current through the half-bridge Q1, Q2 is determined, and supply connections via which a voltage supply is provided for the drive circuit 20. The DC voltage Vb for the ballast is provided, for example, by a switched-mode converter with a power factor correction function (power factor controller, PFC). In this context, reference is made, for example, to EP 1 066 739 B1, U.S. Pat. No. 6,617,805 B2 or U.S. Pat. No. 6,400,095 B1, as cited above.

FIG. 2 shows the waveform of the output voltage V2, which is produced between the output terminal K3 of the half-bridge Q1, Q2 and the reference ground potential GND, of the half-bridge circuit Q1, Q2, of the current Iq2 through the second semiconductor switching element Q2, the current I1 into the load that is connected to the half-bridge circuit Q1, Q2, and the drive signals S1, S2 for the semiconductor switching elements S1, S2 for a disturbance-free operating state after starting of the florescent lamp.

The semiconductor switching elements Q1, Q2 are switched on by the drive circuit 20 via the drive signals S1, S2, with a respective phase shift, for switched-on durations Ton1, Ton2, with the drive periods Tp for the two semiconductor switches S1, S2 each being the same. The drive is provided, for example, in such a way that there is a minimum switched-off time toff between one of the two semiconductor switching elements being switched off and the other being switched on. The switched-on durations Ton1, Ton2 are normally each of equal length, the duty cycle, that is to say the ratio of the switched-on duration to the period duration is, for example, about 45%.

When the first semiconductor switch S1 is switched on and the second semiconductor switch S2 is switched off, the output voltage V2 from the half-bridge circuit Q1, Q2 corresponds approximately to the DC voltage Vb between the terminals K1, K2, ignoring the switched-on resistance of the first semiconductor switching element Q1. This voltage results in a lamp current I1, which flows in the opposite direction to that shown in FIG. 1 and whose magnitude increases as the time for which the first semiconductor switching element S1 is switched on increases. Once the first semiconductor switching element S1 has been switched off, this current is first of all still maintained by virtue of the inductance L1 of the series tuned circuit L1, C1 and thus discharges the snubber capacitor C3, which is connected in parallel with the second semiconductor switching element Q2, as a result of which the voltage across the load path of this second semiconductor switching element Q2 tends to zero. Once this capacitor C3 has been discharged, the body diode of the second semiconductor switching element Q2, which is in the form of an n-channel MOSFET, carries the lamp current I1, in this case acting as a freewheeling diode. This lamp current I1 changes its polarity in the time period after the second semiconductor switching element S2 has been switched on, and flows in the direction shown in FIG. 1 before the second semiconductor switching element S2 is switched off. Once the second semiconductor switching element Q2 has been switched off, the snubber capacitor C3 is charged via the current flowing through the inductance L1 to the value of the DC voltage Vb, with any further voltage rise being limited by an integrated body diode in the first semiconductor switching element, which is formed by an n-channel MOSFET. In this case, the first semiconductor switching element Q1 is not switched on until the voltage at the output K3 has risen to the value of the DC voltage Vb, and the voltage across the load path of the first semiconductor switching element, Q1 is thus zero.

The snubber capacitor C3 assists zero-voltage switching of the first and second semiconductor switching elements Q1, Q2, that is to say switching of these semiconductor switching elements Q1, Q2 when the voltage across their load path is equal to zero. The switches Q1, Q2 can admittedly also be switched on at zero voltage without the snubber capacitor C3. The only precondition for this is that the current through the load path continues to flow with the same polarity until the corresponding switch Q1, Q2 is switched on. Without any snubber capacitor C3, the voltage would, however, rise very quickly after switching off a switch Q1, Q2, leading to corresponding switching-off losses. The snubber capacitor C3 limits this rate of voltage rise, and thus reduces the switching losses.

However, situations in which such zero-voltage switching operation cannot be achieved may occur during operation of a florescent lamp. In this case, the snubber capacitor C3 charge is not changed by means of the current that is induced in the resonant inductance L1 but by means of the currents flowing through the semiconductor switching elements on switching on, and this is associated with considerable losses. Operating states such as these may occur, for example, when the lamp has been removed from the socket or is damaged, or when the DC voltage Vb falls for a lengthy time period during normal operation.

In order to avoid overloading of the semiconductor switching elements which are designed to be continuously loaded only for zero-voltage switching operation during non-zero-voltage switching operation, it is necessary to identify an operating state such as this and, if necessary, to switch off the florescent lamp by interrupting the drive to the half-bridge if this operating state lasts for longer than a predetermined time period.

In order to detect such non-zero-voltage switching operation, it is known from U.S. Pat. No. 6,331,755 B1 and 5,973,943 for a current to be detected by the low-side switch in the half-bridge and to be assessed against a reference value at the time at which the switch is switched on and off. U.S. Pat. No. 6,400,095 B1 and EP 1 066 739 B1 propose that the current through the lamp be detected by means of a shunt resistance, and be assessed against a reference value.

SUMMARY

One aim of the present invention is to provide a method for detection of non-zero-voltage switching operation of a lamp ballast, and to provide a ballast having a detector circuit for detection of non-zero-voltage switching operation.

This aim is achieved by embodiments of the invention.

In the method according to the invention for detection of non-zero-voltage switching operation of a lamp ballast, which has a half-bridge circuit with a first and a second semiconductor switching element, a resonant tuned circuit connected to one output of the half-bridge circuit, and a snubber capacitance connected in parallel with one of the semiconductor switching elements, provision is made for a voltage measurement signal which is dependent on a voltage at the output of the half-bridge to be produced, and for the voltage measurement signal to be evaluated by comparison of the voltage measurement signal with a reference value, in each case before the switching-on times of at least one of the first and second semiconductor switching elements.

In the case of this method, non-zero-voltage switching operation is detected when the voltage measurement signal falls below the level of the reference signal before the switching-on time of the first semiconductor switching element, and/or when the voltage measurement signal exceeds the reference value before the switching-on time of the second semiconductor switching element.

The voltage measurement signal is preferably compared with the reference value in each case before the switching-on times of the first semiconductor switching element and before the switching-on times of the second semiconductor switching element, thus making it possible to distinguish between individual different non-zero-voltage switching operating modes.

The voltage measurement signal in one embodiment of the method is produced by means of a resistive voltage divider from the voltage at the output of the half-bridge, and in another embodiment is produced by means of a capacitive voltage divider from the voltage at the output of the half-bridge.

The lamp ballast according to the invention has a half-bridge circuit with a first and a second semiconductor switching element, which are driven on the basis of first and second drive signals, and having an output at which a half-bridge voltage is produced, and has a resonant tuned circuit which is connected to the output of the half-bridge circuit. The lamp ballast also has a detector circuit for detection of non-zero-voltage switching operation, having the following features: [0021] a voltage measurement arrangement which is connected to the output of the half-bridge circuit and provides a voltage measurement signal based on the half-bridge circuit, [0022] an evaluation circuit to which the voltage measurement signal is supplied and which is designed to evaluate the voltage measurement signal by comparison of the voltage measurement signal with a reference value, in each case before the switching-on times of at least one of the first and second semiconductor elements, and to produce at least one evaluation signal on the basis of this comparison.

In order to preset the evaluation times, the lamp ballast is supplied, for example, with at least one of the first and second drive signals.

BRIEF DESCRIPTION OF THE DRAWINGS

The present invention will be explained in more detail in the following text with reference to figures, in which.

DETAILED DESCRIPTION

Unless stated to the contrary, identical reference symbols denote identical circuit components and signals with the same meaning in the figures.

Figure 1:
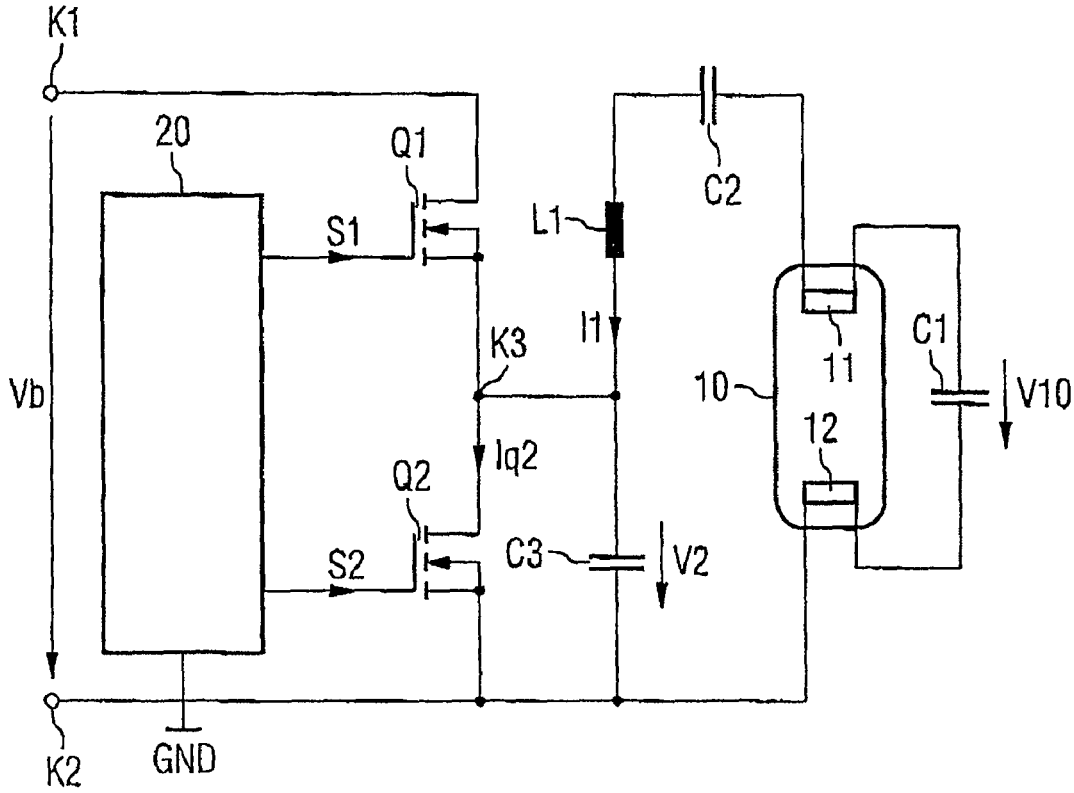
FIG 1 Prior art
FIG. 1 shows the fundamental design of a lamp ballast with a florescent lamp inserted (prior art).
Figure 2:
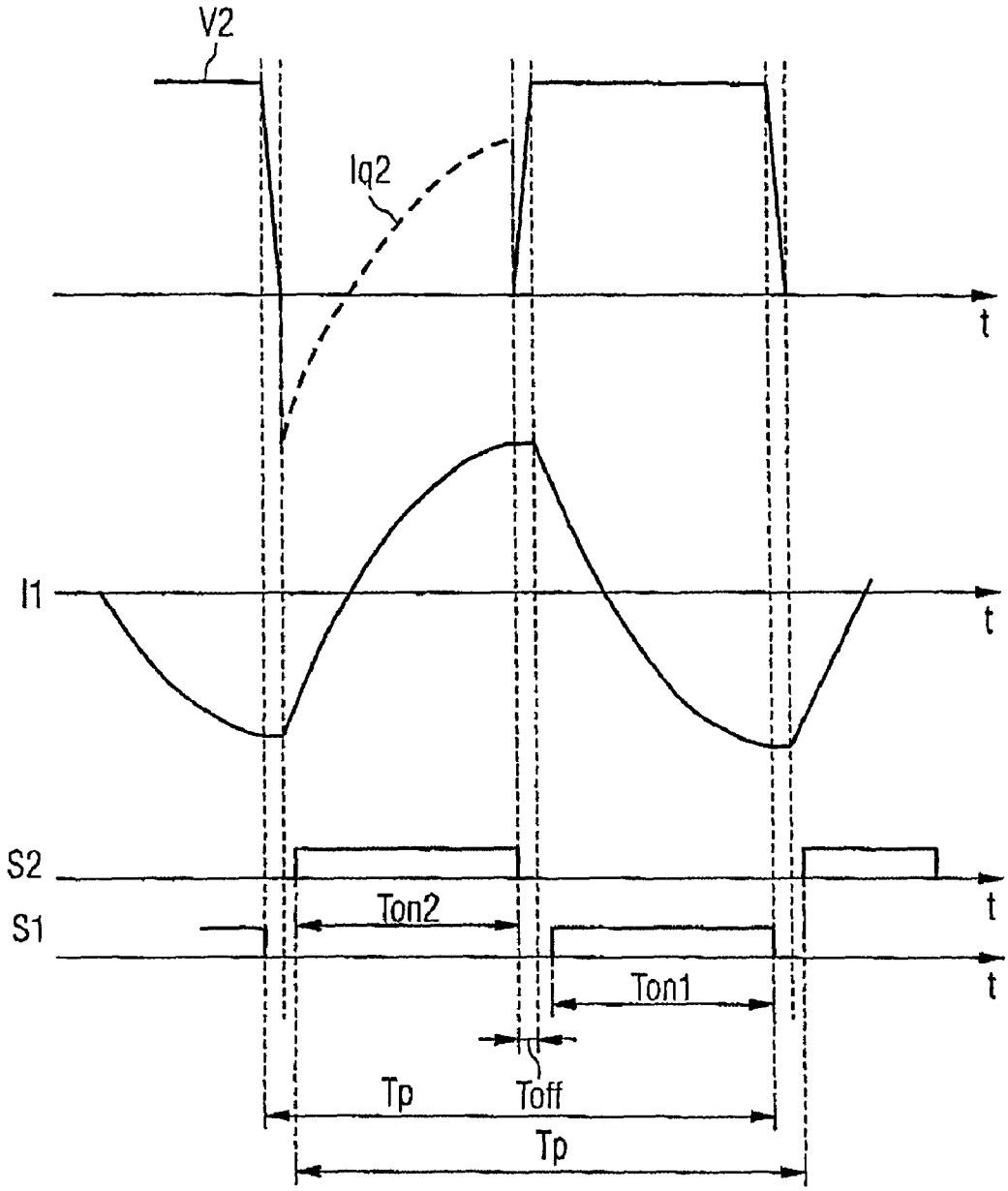
FIG 2 Prior art
FIG. 2 shows the waveform of selected signals in the lamp ballast as shown in FIG. 1, during zero-voltage switching operation (prior art).
Figure 3:
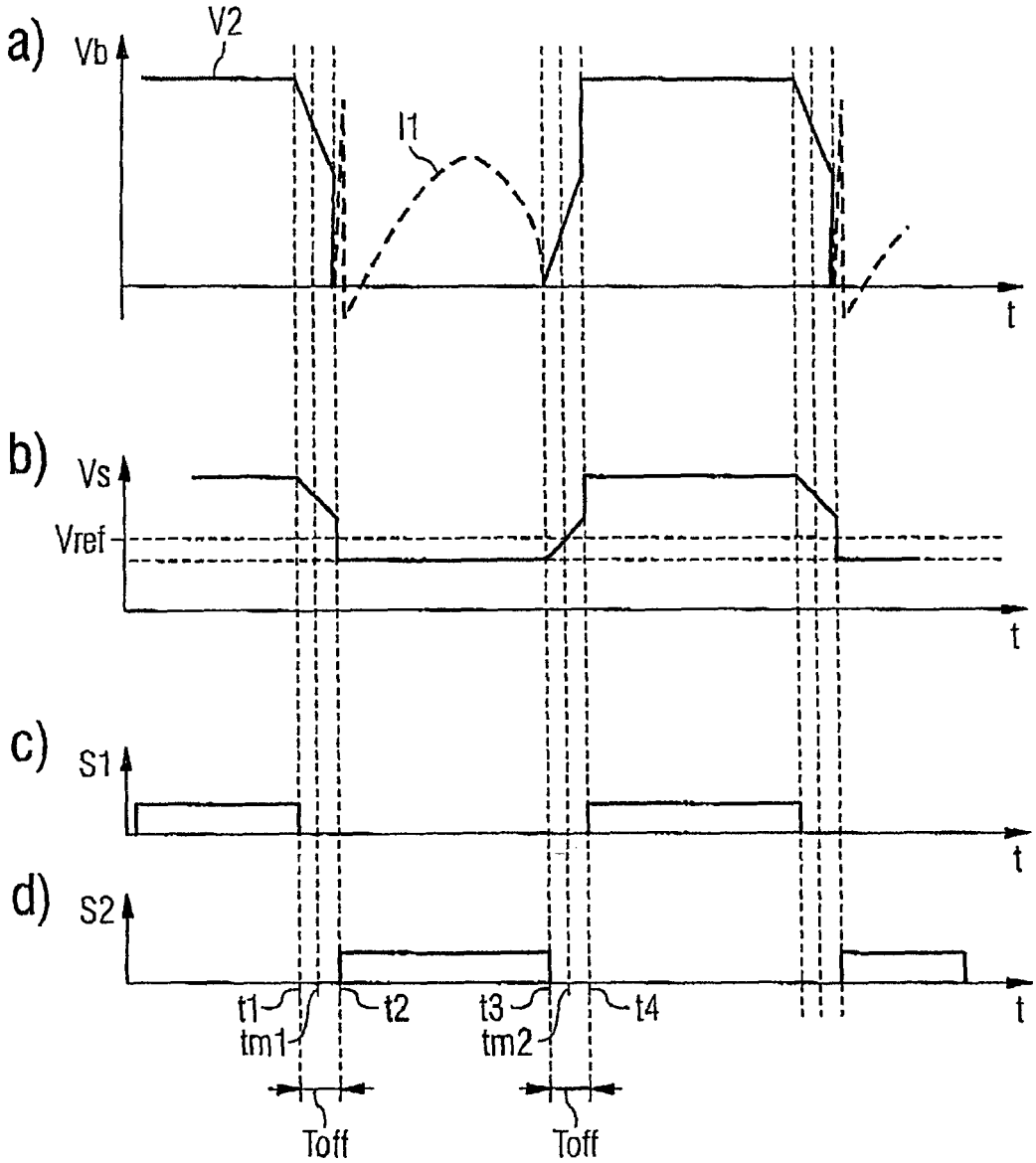
FIG. 3 shows, by way of example, waveforms of the output voltage of a half-bridge in a lamp ballast (FIG. 3*a*), the waveform which results from this of a voltage measurement signal that is derived from this voltage (FIG. 3*b*), as well as waveforms of drive signals for the half-bridge circuit (FIGS. 3*c* and 3*d*) for non-zero-voltage switching operation of a first type, in order to explain the detection method according to the invention.

By way of example, FIG. 3 shows waveforms of drive signals S1, S2 for switching elements Q1, Q2 in a half-bridge in a lamp ballast, for example a lamp ballast as shown in FIG. 1, which is designed for zero-voltage switching operation and has a snubber capacitor C3 connected to one output terminal K3 of the half-bridge Q1, Q2. A time period between times t1 and t4 will be considered in more detail in the following text. At a first time t1, the first switch Q1 in the half-bridge is switched off, driven by the first drive signal S1, at a second time t2, the second switch Q2 in the half-bridge is switched on, driven by the second drive signal S2, at a third time t3, the second switch Q2 is switched off, and at a fourth time t4 the first switch Q1 is switched on. In order to prevent the two switches Q1, Q2 being driven such that they are switched on at the same time, a dead time Toff is provided between the first and the second times, t1, t2 and between the third and fourth times t3, t4, during which neither of the two switches Q1, Q2 is intended to be switched on. With reference to the statements relating to FIG. 2, this dead time between the first switch Q1 being switched off and the second switch Q2 being switched on is used in order to draw the potential at the output terminal K3 to zero or to the reference ground potential GND, and the dead time between the second switch Q2 being switched off and the first switch Q1 being switched on is used to draw the output K3 to the supply potential Vb. The voltage across the switching elements Q1, Q2 when they are switched on is then zero.

Figure 4:
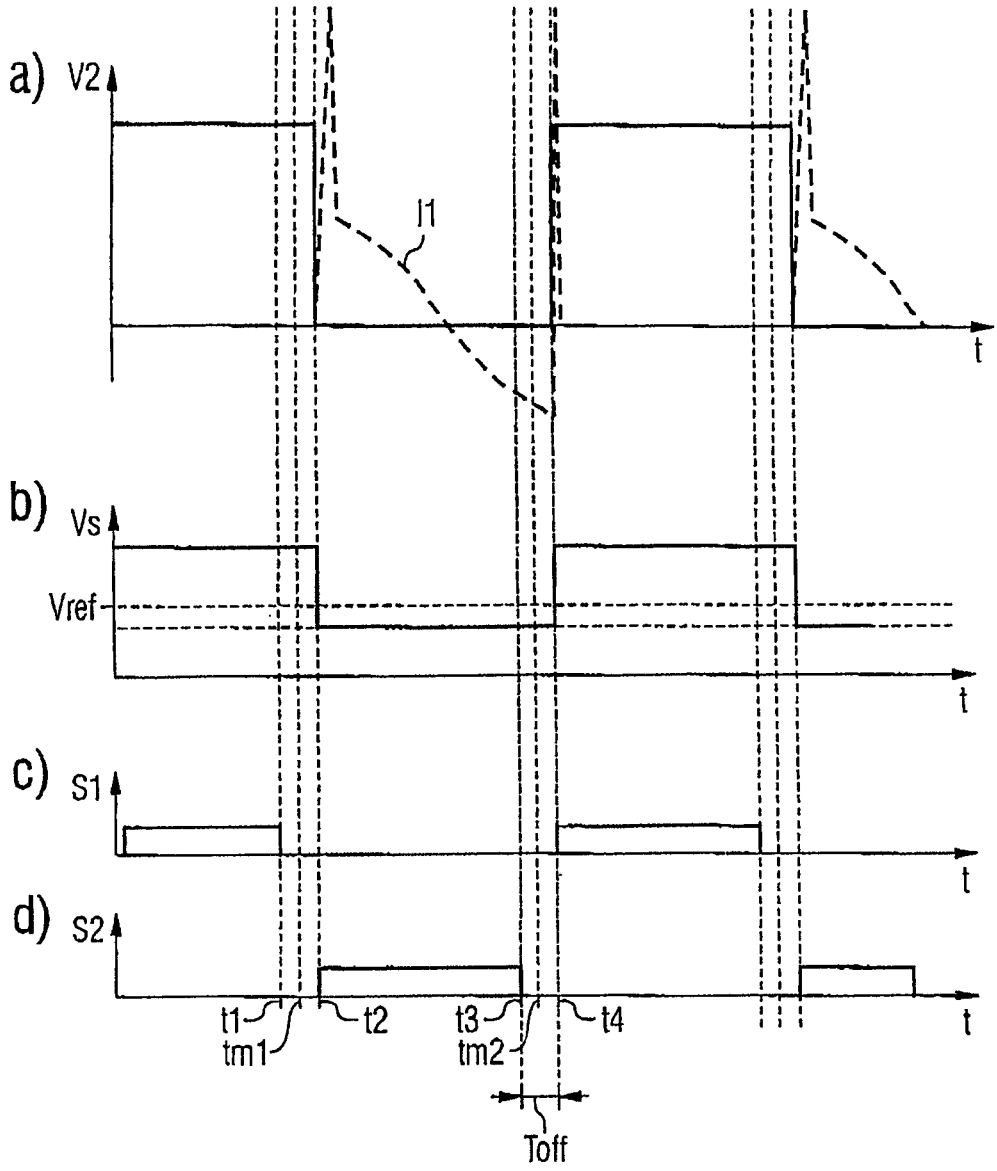
FIG. 4 shows, by way of example, waveforms of the output voltage of a half-bridge in a lamp ballast (FIG. 4*a*), the waveform which results from this of a voltage measurement signal that is produced on the basis of this voltage (FIG. 4*b*), as well as waveforms of drive signals for the half-bridge circuit (FIGS. 4*c* and 4*d*) for non-zero-voltage switching operation of a second type, in order to explain the detection method according to the invention.

It should be noted that unavoidable delay times between the flanks of the drive signals S1, S2 and the switching-on times of the switches S1, S2 are ignored in FIGS. 3 and 4, for clarity reasons.

FIG. 3*a* shows the waveform of the output voltage V3 from the half-bridge in a lamp ballast for non-zero-voltage switching operation of a first type. In this case, although the output voltage V2 falls from the first time t1 when the first switch is switched off, the dead time Toff, however, is not sufficient in order to draw the output voltage V2 to zero or to the reference ground potential GND before the second switch T2 is switched on, so that a voltage which is not equal to zero is present across the second switch Q2 when it is switched on, and this leads to increased switching losses. In a corresponding manner, during this operating state, the dead time between the second switch Q2 being switched off and the first switch Q1 being switched on is not sufficient in order to draw the output voltage V2 to the value of the operating voltage Vb, so that a voltage which is not equal to zero is present across this first switch S1 at its switching-on time t4, and this leads to increased switching losses.

In order to detect this non-zero-voltage switching operation, the method according to the invention provides for a voltage measurement signal Vs to be produced, which is dependent on the output voltage V2 from the half-bridge. The waveform of the signal Vs such as this, which is dependent on the waveform of the output voltage in the example, is illustrated in FIG. 3*b*. Provision is also made for a reference value Vref to be produced and for the voltage measurement signal Vs to be compared with the reference value Vref before the switching-on times of the first and/or second switch Q1, Q2, in order to detect non-zero-voltage switching operation. In FIG. 3, a first comparison time, which is located between the first and the second times t1, t2, is annotated tm1, and a second comparison time, which is located between the third and the fourth times t3, t4, is annotated tm2.

Non-zero-voltage switching operation is detected using the method according to the invention when the voltage measurement signal Vs has not yet fallen below the reference value Vref at the first comparison time tm1 before the second switch Q2 is switched on (at the time t2), and/or when the voltage measurement signal Vs has not yet risen above the reference value Vref at the second comparison time tm2 before the second switch Q2 is switched on (at the time t4). The time interval between the respective comparison times tm1, tm2 and the switching-on times t2, t4 as well as the threshold of the reference value Vref are chosen such that, during correct zero-voltage switching operation, the voltage measurement signal Vs has already fallen below the reference value Vref at the first comparison time tm1, and has already risen above the reference value Vref at the second comparison time tm2.

FIG. 4 shows the waveform of the output voltage V2 from the half-bridge Q1, Q2, as a function of the first and second drive signals S1, S2 (FIGS. 4*c* and 4*d*), for non-zero-voltage switching operation of a second type, which can occur, by way of example, in the event of the florescent lamp 10 being broken during operation, or in the event of the florescent lamp being removed. Once the first switch Q1 has switched off, the output voltage from the half-bridge circuit in this operating state would rise owing to the current induced in the resonant inductance L1. The potential at the output K3 is, however, kept approximately at the supply potential Vb until the second switch Q2 is switched on at the time t2, by means of a free-wheeling diode which is integrated in the switch Q1 (which, for example, is in the form of a n-channel MOSFET) or, possibly, by means of a freewheeling diode which is connected in parallel with the switch Q1. The charge which is stored in the freewheeling diode in the first switch Q1 while in the conducting state must be dissipated when the second switch Q2 is switched on, and this leads to considerable switching losses in the two switches Q1, Q2. Once the second switch Q2 has been switched off, the potential at the output K3 initially remains at the reference ground potential, until the first switch Q1 is switched on at the time t4, as a result of the freewheeling diode that is integrated in the second switch Q2 or, possibly, as a result of a freewheeling diode connected in parallel with this switch. The charge which is stored in the freewheeling diode in the second switch Q2 must in this case first of all be dissipated when the first switch Q1 is switched on, and this also leads to considerable switching losses in the two switches Q1, Q2 during this switching process. This operating state must be detected on the basis of the increased switching losses, in order if required to switch off the lamp ballast and to protect it against damage.

This non-zero-voltage switching operation of the second type can also be detected by means of the method according to the invention by comparing the voltage measurement signal Vs (which is derived from the output voltage V2 and whose waveform is illustrated in FIG. 4*b*) with the reference value Vref. Since, during the illustrated non-zero-voltage switching operation, the voltage measurement signal Vs does not start to fall until the second switch S2 is switched on at the time t2, the voltage measurement signal Vs at the first comparison time tm1 is undoubtedly above the reference value Vref, and, since the voltage measurement signal Vs does not start to rise until the fourth time t4 when the first switch Q1 is switched on, the voltage measurement signal Vs is undoubtedly below the reference value Vref at the second comparison time tm2.

The reference value Vref is chosen in such a way that it is located between the maximum possible signal value and the minimum possible signal value of the voltage measurement signal Vs, with the reference value preferably being closer to the minimum value than to the maximum value. These values are, in particular, dependent on the manner in which the voltage measurement signal Vs is obtained from the output voltage V2 from the half-bridge Q1, Q2.

Figure 5:
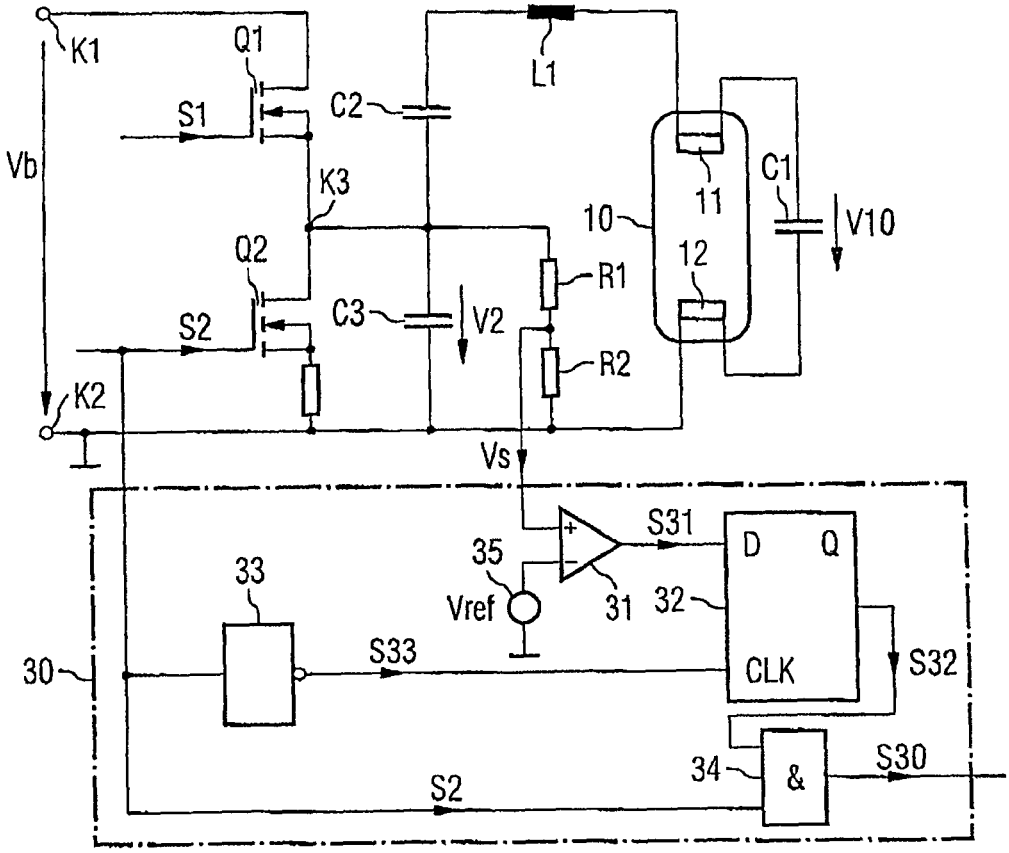
FIG. 5 shows a first exemplary embodiment of a detector circuit for detection of non-zero-voltage switching operation, which has a resistive voltage divider for determination of a voltage measurement signal.

FIG. 5 shows a first exemplary embodiment of a detector circuit according to the invention for detection of non-zero-voltage switching operation. In order to assist understanding.

FIG. 5 also shows further components of the lamp ballast, specifically the half-bridge Q1, Q2, the resonant tuned circuit L1, C1 with the blocking capacitor C2, the snubber capacitor C3, and a florescent lamp 10 inserted into the ballast.

The detector circuit in the example has a resistive voltage divider R1, R2, which is connected between output K3 of the half-bridge Q1, Q2 and the reference ground potential GND and at whose center tap the voltage measurement signal Vs is available, as the voltage measurement arrangement for provision of a voltage measurement signal Vs which is dependent on the output voltage V2 from the half-bridge Q1, Q2. This voltage measurement signal Vs is supplied to an evaluation circuit 30 which produces a status signal S30, which assumes a first level during zero-voltage switching operation, and a second level during non-zero-voltage switching operation.

The evaluation circuit 30 has a reference voltage source 35, which provides the reference value Vref. The reference value Vref and the voltage measurement signal Vs are supplied to a comparator 31, which produces a comparison signal S31 that is dependent on the comparison of the voltage measurement signal Vs with the reference value Vref. This comparison signal S31 is supplied to the data input D of a D-flipflop 32, which carries out the function of a sampling and storage unit. The comparison signal S31 is sampled on the basis of a clock signal S33, which is derived from the second drive signal S2 by inversion by means of an inverter 33 and is supplied to a clock input CLK of the flipflop 32. The flipflop 32 is level-controlled and in each case receives the instantaneous value of the comparison signal S31 while the clock signal is at a high level, and retains the most recently stored value after a falling flank of the clock signal S33. The value which is stored in the flipflop 31 is available at its output. This output signal S32 from the flipflop 32 is linked by means of an AND gate 34 to the second drive signal S2, in order to produce the status signal S30.

Figure 6:
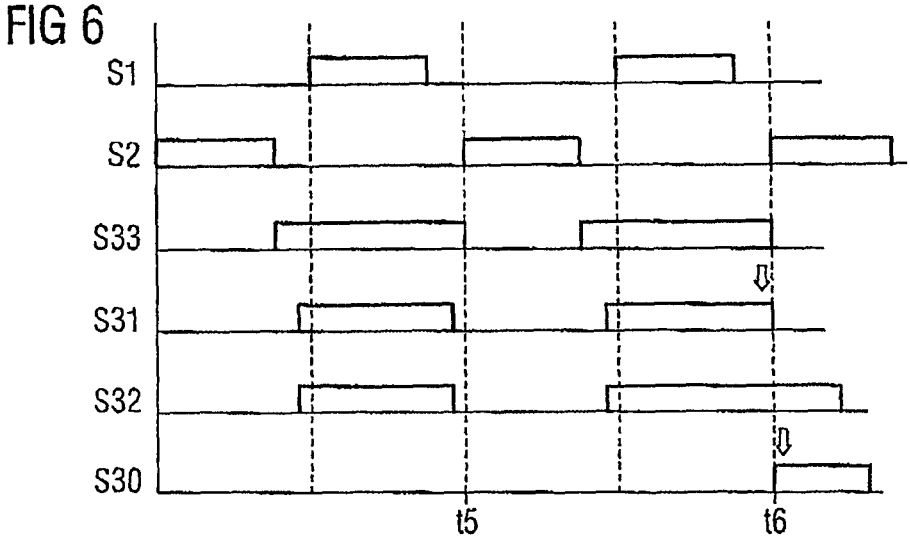
FIG. 6 shows, by way of example, waveforms of the signals which occur in the detector circuit shown in FIG. 5.

The method of operation of the detector circuit illustrated in FIG. 5 will become clear from the waveform of the signals in FIG. 6, as illustrated in the evaluation circuit shown in FIG. 5. By way of example, FIG. 6 shows the waveforms of the first and second drive signals S1, S2, of the clock signal, S33 which corresponds to the inverted second drive signal S2, of the comparison signal S31, and the waveforms which result therefrom of the flipflop output signal S32 and of the status signal S30.

The comparison signal S31 is evaluated by the detector circuit at each of the switching-on switching times of the second switch Q2, in which case, with reference to the statements relating to FIGS. 4 and 5, non-zero-voltage switching operation is assumed when the voltage measurement signal Vs is greater than the reference value Vref at the evaluation time. The evaluation times in the case of the detector circuit shown in FIG. 5 are in each case predetermined by falling flanks of the clock signal S33, that is to say rising flanks of the second drive signal S2. In this case, use is made of the fact that there is an unavoidable time delay between the rising flank of the second drive signal S2 and the actual switching of the second switch Q2, in which case this delay time predetermines the time interval between the comparison time and the switching-on time of the second switch Q2. The delay time between the rising flank of the second drive signal S2 and the second switch Q2 being switched on is normally considerably greater than the processing times or gate response times in the evaluation circuit 30. The delay time between the rising flank of the second drive signal S2 and the second switch Q2 being switched on is governed predominantly by driver circuits which are not described in any more detail and convert the logic drive signals S1, S2 to levels which are suitable for driving the switches Q1, Q2. It is optionally possible to connect delay elements (not illustrated) upstream of the drive connections of the switches Q1, Q2 in order in this way to achieve a further delay between the rising flank of the second drive signal S2 and the second switch Q2 being switched on, with this delay time also governing the time interval, as explained with reference to FIGS. 4 and 5, between the first comparison time tm1 and the time t2 at which the second switch Q2 is switched on.

With reference to the waveforms shown in FIG. 6, the lamp ballast is first of all operated with zero voltage switching, that is to say the voltage measurement signal Vs has already fallen below the reference value Vref at a time t5 of a rising flank of the second drive signal S2, thus resulting in the comparison signal S31 being at a low level. During zero-voltage switching operation, a low level is produced at the output of the flipflop 32 when the second switch S2 is switched on, thus resulting in the status signal S30 being at a low level. As progress is made through the timing diagram shown in FIG. 6, non-zero-voltage switching operation starts, as a result of which the comparison signal S31 assumes a high level at a time t6 of a rising flank of the second drive signal S2, and this is transferred to the flipflop 32. This high level at the output of the flipflop leads, in conjunction with the high level of the second drive signal S2, to the status signal S30 being at a high level, in order to indicate non-zero-voltage switching operation of the lamp ballast.

Instead of the level-controlled flipflop 32, a flank-controlled flipflop could also be used in the evaluation circuit 30, which stores the value of the comparison signal S31 on each positive flank of the second drive signal S2 and thus on a falling flank of the clock signal S33, and makes this available as the output signal at its output. The output signal from this flip-flop could then be used directly as the status signal S30. In this case, there would be no need for the AND gate 34.

The detector circuit which has been explained with reference to FIG. 5 may, of course, be integrated in a central drive circuit, corresponding to the drive circuit 20 in FIG. 1. The resistors R1, R2 in the resistive voltage part may in this case be provided as external components to the drive circuit 20, which is normally in the form of an integrated circuit.

Figure 7:
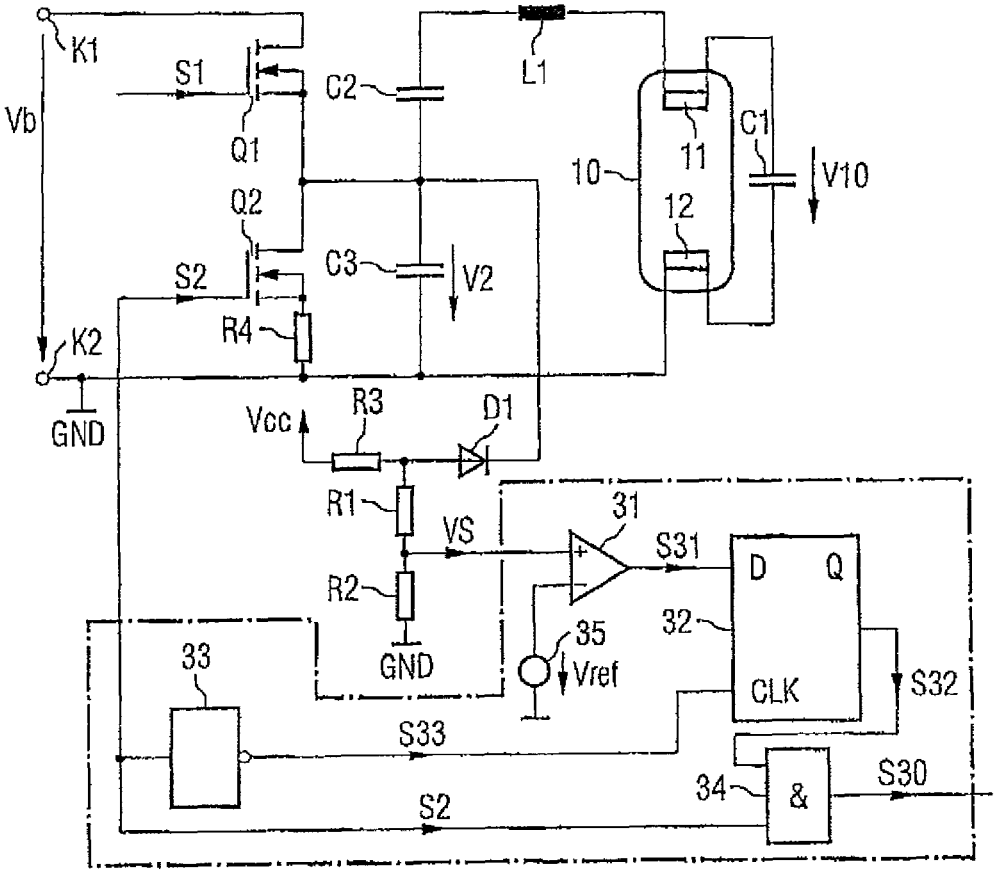
FIG. 7 shows a further exemplary embodiment of a detector circuit with a resistive voltage divider.

FIG. 7 shows an exemplary embodiment of the detector circuit which allows the resistance elements R1, R2 of the voltage divider to be integrated in an integrated circuit. In this exemplary embodiment, the voltage measurement arrangement has a further resistor R3 and a diode in addition to the resistance elements R1, R2 of the voltage divider, with the further resistor R1 being connected in series with the diode D1 between a supply potential Vcc and the output K3 of the half-bridge. The resistive voltage divider R1, R2 is in this example located between the reference ground potential GND and a node which is common to the further resistor R3 and the diode D1.

The diode D1 in this case prevents high voltage from reaching the resistors R1, R2, while the resistor R3 ensures that a defined voltage value is applied to the anode of the diode D1 when the diode is reverse-biased. When the second switch Q2 is switched on, the voltage at the anode of the diode D1 corresponds to the output voltage V2 from the half-bridge Q1, Q2 plus the voltage drop across the forward-biased diode. When the first switch Q1 is switched on, the resistor R3 and the resistors R1 and R2 form a voltage divider, which divides the voltage Vcc. This circuit arrangement is used to detect whether the output voltage V2 is less than the supply voltage Vcc minus the voltage drop across the resistor R3 and the threshold voltage of the diode D1.

Figure 8:
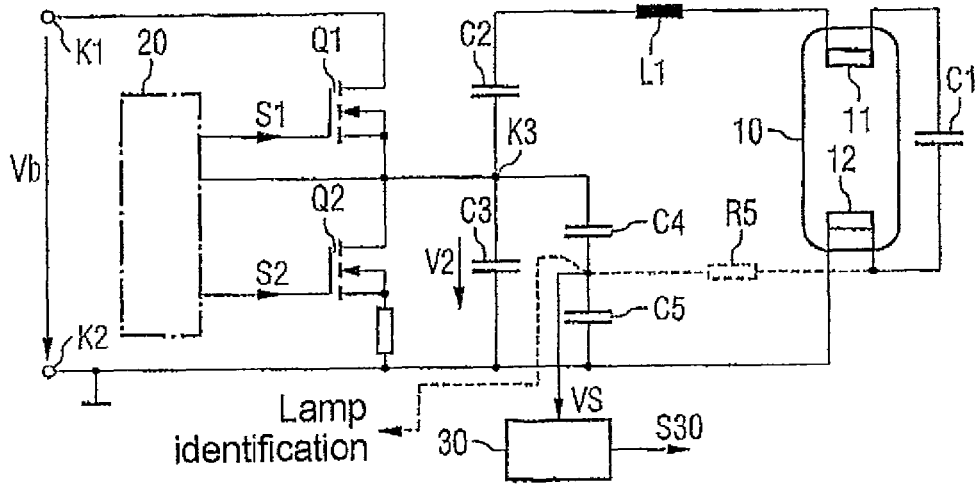
FIG. 8 shows an exemplary embodiment of a detector circuit according to the invention with a capacitive voltage divider.

A capacitive voltage divider C4, C5 can also be used, instead of a resistive voltage divider, to produce the voltage measurement signal Vs from the output voltage V3 from the half-bridge. FIG. 8 illustrates a lamp ballast with a capacitive voltage divider such as this. The capacitive voltage divider has two capacitors C4, C5, which are connected in series between the output K3 of the half-bridge circuit and the reference ground potential GND and which have a center tap at which the voltage measurement signal Vs can be tapped off. This voltage measurement signal Vs is supplied to the evaluation circuit 30 which, for example, is designed in a corresponding manner to the evaluation circuit in FIG. 5.

In comparison to resistive voltage dividers, a capacitive voltage divider has the advantage of having a shorter signal delay when high-speed switching processes take place, and of having a lower power consumption. Furthermore, the capacitors C4, C5 which are required for the capacitive voltage divider may, for example, be thick-oxide capacitors with an oxide thickness of between 2 and 3 .mu.m, or may be in the form of gate-oxide capacitors with an oxide thickness in the order of magnitude between 20 nm and 50 nm, so that the capacitors C4, C5 in the capacitive voltage divider can be produced together with the control circuit 20 (illustrated by dashed lines in FIG. 8) and the evaluation circuit 30 in a common semiconductor chip, so that no additional external components are required for the voltage divider.

One of the two capacitors in the voltage divider C4, C5 may, in particular, be part of a circuit arrangement, the rest of which is not illustrated in any more detail but which detects the presence of a florescent lamp. In addition to the capacitor, in the example the capacitor C5 which is connected to the reference ground potential GND, a lamp identification circuit such as this requires a resistor R5, which is connected between this capacitor C5 and the connection which is common to the lamp electrode 12 and the resonant capacitor C1. The capacitor C5 and the resistor R5 form a low-pass filter, with a lamp identification circuit, which is not illustrated in any more detail but is connected to the node that is common to the capacitor C5 and the resistor R5, being designed to apply a test current to the resistor R5 and to the lamp filaments 12, and to monitor the voltage drop across the resistor R5 and the lamp filaments 12. When no lamp is inserted or the filament is defective, the voltage across the capacitor C5 rises as a result of the test current and the lack of any discharge path. During normal operation, the operating current of the lamp results in a high-amplitude AC voltage across the filament. The low-pass filter that is formed from the capacitor C5 and the resistor R5 is used to keep this AC voltage away from the other circuit parts, which are formed in an integrated circuit.

When a lamp identification circuit such as this is present, only one additional capacitor C4 is required to produce the capacitive half-bridge, and is connected between the capacitor C5 in the lamp identification circuit and the output K3 of the half-bridge.

Figure 9:
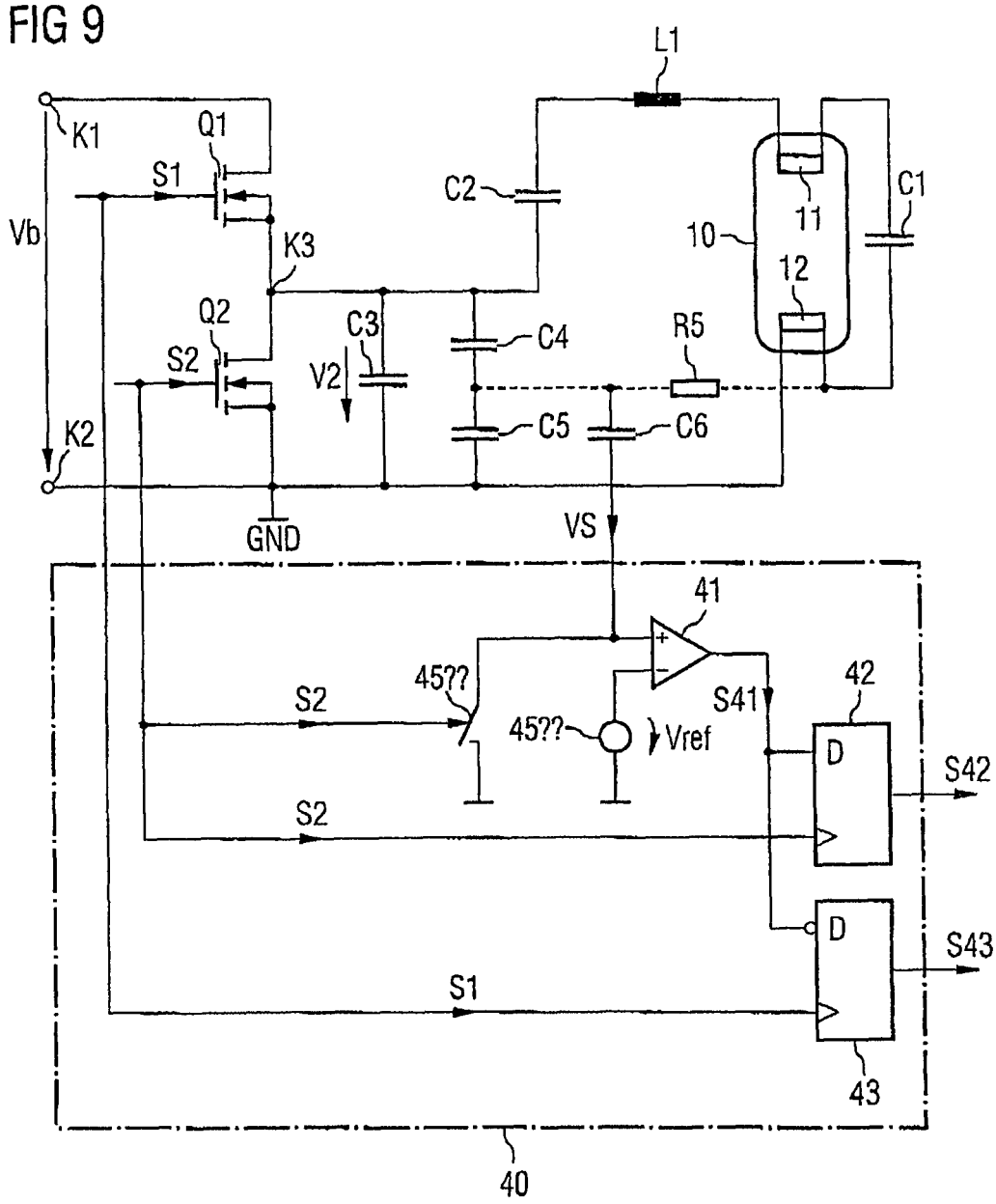
FIG. 9 shows a further exemplary embodiment of a detector circuit according to the invention with a capacitive voltage divider for determination of the voltage measurement signal.

FIG. 9 shows a further exemplary embodiment of an evaluation circuit 40, which is particularly suitable for evaluation of a voltage measurement signal Vs obtained by means of a capacitive voltage divider C4, C5.

This evaluation circuit 40 has a comparator 41, one of whose inputs is supplied with the voltage measurement signal Vs, and whose other input is supplied with a reference value Vref produced by a reference voltage source 45. A comparison signal, S41 is produced at the output of this comparator 41 and is supplied to a data input D of a first flipflop 42 and to the one inverting data input D of a second flipflop 43. The two flipflops 42, 43 are flank-triggered flipflops which in each case receive and store the respective signal applied to the data input on a rising flank of a clock signal that is supplied to them. The second drive signal S2 is supplied as a clock signal to the first flipflop 42, and the first drive signal S1 is supplied as a clock signal to the second flip flop 43. A first status signal S42 is produced at one output of the first flipflop 42, with a second status signal S43 being produced at one output of the second flipflop 43, which are used to indicate non-zero-voltage switching operation.

Once again, it is assumed that the flanks of the first and second drive signals S1, S2 each occur before the actual switching times of the switches, owing to unavoidable switching delays in the switches Q1, Q2. The comparison signal S41 is then evaluated via the first flip flop 42, which is driven by the second drive signal S2, in each case shortly before the second switch Q2 is switched on, and the comparison signal S41 is then evaluated via the second flip flop 43, which is driven by the first drive signal S1, in each case shortly before the first switch Q1 is switched on. This results in a distinction being drawn between two different non-zero-voltage switching operating modes, as will be explained in more detail in the following text with reference to FIGS. 11 and 12.

In the exemplary embodiment, a further capacitor C6 is optionally connected between the center tap of the capacitive voltage divider C4, C5 and carries out the function of a coupling capacitor, with the voltage measurement signal being produced at its connection that is remote from the center tap. However, there is no need for this coupling capacitor C6 if the capacitor C5 in the capacitive voltage divider is not part of a lamp identification circuit, that is to say if no non-reactive resistance is connected between the center tap of the voltage divider and the lamp filaments or the lamp electrode 12.

The evaluation circuit 40 also has a switch 45, which is connected between the reference ground potential GND and that input of the comparator 41 to which the voltage measurement signal Vs is supplied. This switch 45 is driven by the second drive signal S2 and is switched on when the second semiconductor switching element Q2 is switched on. The voltage measurement signal Vs is set to a defined potential by means of this switch 45 during the time in which the second switch Q2 is switched on, and this results, after the second switch Q2 has been switched off and the first switch Q1 has been switched on, that is to say when the output voltage V2 of the half-bridge is rising, in the voltage measurement signal Vs following the output voltage V2 with respect to the reference ground potential GND, corresponding to the division ratio of the capacitive voltage divider C4, C5. The example is based on the assumption that the switch 45 in the evaluation circuit is driven by the second switch Q2 in the half-bridge at the same time. However, correct operation is dependent on the voltage measurement signal Vs being set to a defined potential during the time period in which the second switch Q2 is switched on. The switch 45 may for this purpose also be closed only after the switch Q2 and may also be opened again before the second switch Q2.

In summary, the further switch 45 results in the information which is normally not transmitted by a capacitive voltage divider being recovered via the DC component of the voltage V2, so that the voltage measurement signal Vs is proportional to the output voltage V2, and is related to the same reference ground potential GND.

Figure 10:
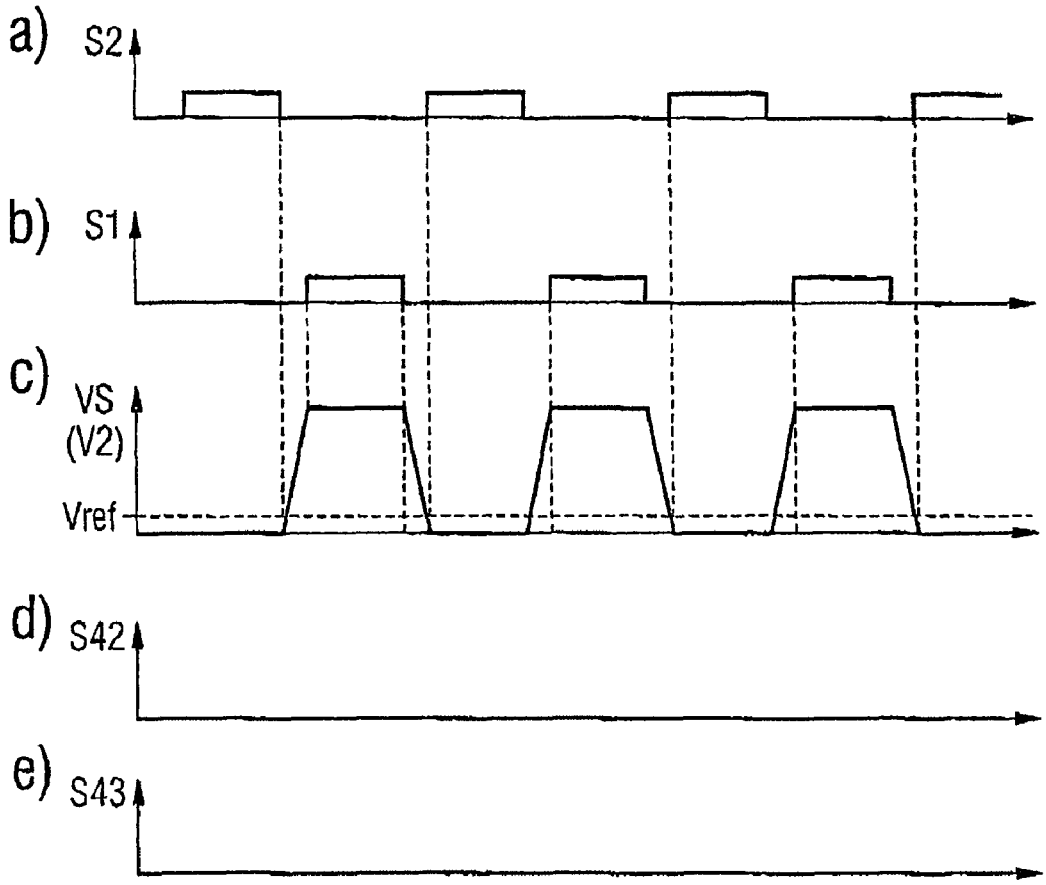
FIG. 10 shows waveforms of selected signals which occur in the detector circuit as shown in FIG. 9, for zero-voltage switching operation of the lamp ballast.
Figure 11:
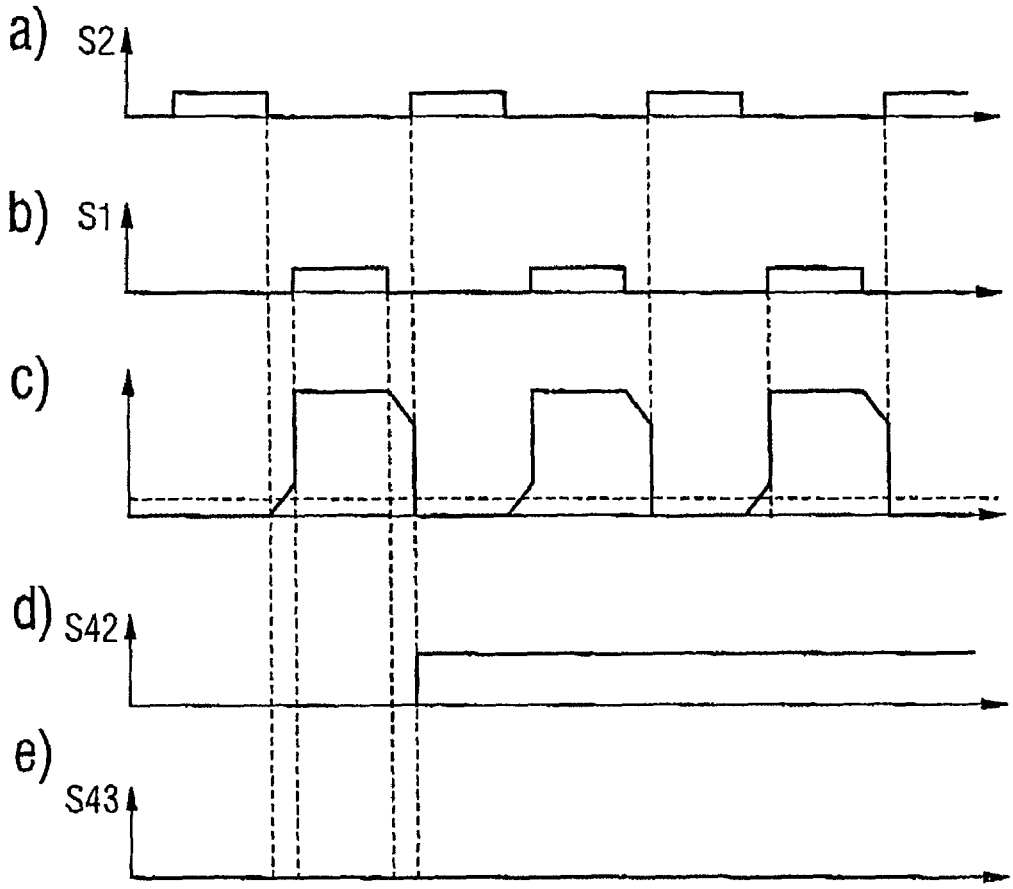
FIG. 11 shows waveforms of selected signals which occur in the detector circuit as shown in FIG. 9, for non-zero-voltage switching operation of a first type.
Figure 12:
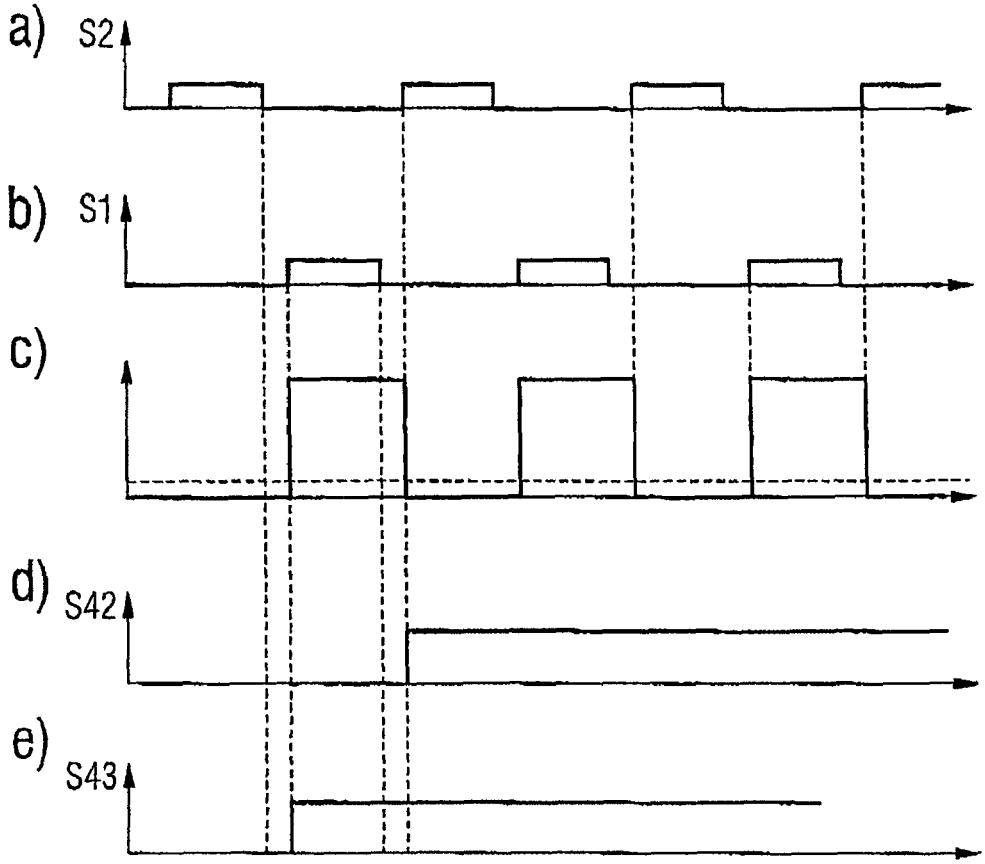
FIG. 12 shows examples of waveforms of selected signals in the detector circuit as shown in FIG. 9 for non-zero-voltage switching operation of a second type.

The method of operation of the evaluation circuit 40 shown in FIG. 9 will be explained in the following text with reference to FIGS. 10, 11 and 12, with FIG. 10 showing waveforms of the signals which occur in the evaluation circuit for zero-voltage switching operation, and FIGS. 11 and 12 showing waveforms of the signals for non-zero-voltage switching operation of a first and of a second type.

FIGS. 10*a* and 10*b* show the waveforms of the first and second drive signals S1, S2, and FIG. 10*c* shows the waveform of the voltage measurement signal Vs which results from these drive signals S1, S2 and is proportional to the output voltage V2, for zero-voltage switching operation of the half-bridge circuit. As can be seen, the voltage measurement signal rises during the dead times between the second switch Q2 being switched off and the first switch Q1 being switched on to its maximum value during the dead times between the second switch Q2 being switched off and the first switch Q1 being switched on, and falls to its minimum value during the dead times between the first switch Q1 being switched off and the second switch Q2 being switched on. At the times of rising flanks of the second drive signal S2, the voltage measurement signal Vs has in this case always already fallen below the reference value Vref, so that the first status signal S42 assumes a low level. At times of rising flanks of the first drive signal S1, the voltage measurement signal Vs has always already exceeded the reference value Vref, thus resulting in the comparison signal S41 being at a high level at these times and, inverted, these lead to low levels of the second status signal S43. In this evaluation circuit 40, zero-voltage switching operation is thus indicated by low levels of both status signals S42, S43.

FIG. 11*c* shows the waveform of the voltage measurement signal Vs for non-zero-voltage switching operation (as explained with reference to FIG. 3) of the first type as a function of the first and second drive signals (FIGS. 11*b* and 11*a*). During this operating state, when a rising flank of the second drive signal S2 occurs, the voltage measurement signal Vs has never yet fallen below the reference value Vref, so that the first flipflop 42 receives a high level with a rising flank of the second drive signal S2. The first status signal S42 then assumes a high level, as is illustrated in FIG. 11*d*.

With reference to FIG. 11*e*, the second status signal S43 remains at a low level, since the voltage measurement signal Vs will always have already exceeded the reference value Vref when rising flanks occur.

FIG. 12 shows the waveform of the voltage measurement signal Vs for non-zero-voltage switching operation (which has already been explained with reference to FIG. 4) of the second type, during which the output voltage V2 and thus the voltage measurement signal Vs in each case rise only with a rising flank of the first drive signal S1, and in each case fall only after a rising flank of the second drive signal S2. This results in the comparison signal S41 being at a high level when a rising flank of the second drive signal S2 occurs, and thus in the first status signal S42 being at a high level. When a rising flank of the first drive signal occurs, the comparison signal S41 assumes a low level, resulting in the second status signal S43 being at a high level.

In summary, the evaluation circuit 40 as shown in FIG. 9 can distinguish between two different non-zero-voltage switching operations operating modes, with only the first status signal S42 assuming a high level in a first non-zero-voltage switching operating mode, while both status signals S42, S43 assume a high level in a second non-zero-voltage switching operating mode.

In general, in the case of the method which has been explained with reference to FIGS. 10 to 12, a first and a second comparison time occur during each period of the drive to the half-bridge, with the first comparison time being chosen as a function of the timing of a predetermined flank—the rising flank in the example—of the first drive signal S1, and with the second comparison time being chosen as a function of the timing of a predetermined flank—the rising flank in the example—of the second drive signal S2. Non-zero-voltage operation of a first type is detected in the case of this method when the voltage measurement signal Vs is greater than the reference value Vref at the first comparison time and at the second comparison time (see FIG. 11). Non-zero-voltage operation of the second type is in the case of this method detected when the voltage measurement signal Vs is greater than the reference value Vref at the first comparison time is less than the reference value Vref at the comparison time and is greater than the reference value Vref at the second comparison time (see FIG. 12).

In both cases, the reference value Vref is chosen for determination of the operating state such that it is located asymmetrically between a maximum level and a minimum level of the voltage measurement signal Vs, and in this case preferably closer to the minimum level. In this case, the voltage measurement signal Vs assumes the minimum level when the output voltage V2 from the half-bridge is zero, and the voltage measurement signal assumes the maximum level when the output voltage V2 assumes the value of the supply voltage Vb.

The different non-zero-voltage switching operating modes which have been explained above lead to different power losses being produced in the half-bridge circuit, with the zero-voltage switching operation explained with reference to FIGS. 4 and 12 leading to higher power losses than the non-zero-voltage switching operation which has been explained with reference to FIGS. 3 and 11. Non-zero-voltage switching operation of the second type is thus permissible only for a shorter time period than non-zero-voltage switching operation of the first type, in order to prevent damage to the ballast. The information obtained by the evaluation circuit 40 as shown in FIG. 9 about which non-zero-voltage switching operating mode has occurred can thus be used in the control circuit (which is not illustrated in any more detail in FIG. 9) for the half-bridge circuit Q1, Q2 in order to allow the different non-zero-voltage switching operating modes for time periods of different duration, before the drive to the half-bridge circuit is interrupted and the lamp ballast is switched off, in order to prevent damage resulting from overheating.

We claim:

1. A method for detection of a non-zero-voltage switching operation of a first and a second type of a lamp ballast, the lamp ballast including a half-bridge circuit with a first and a second semiconductor switching element, a resonant circuit connected to the half-bridge circuit, and a snubber capacitance connected in parallel with one of the semiconductor switching elements, the method comprising:

a) obtaining a voltage measurement signal representative of a voltage at an output of the half-bridge circuit;

b) providing a comparison signal representative of a comparison of the voltage measurement signal with a reference value, wherein the reference value is selected such that it is located asymmetrically between a minimum possible value and a maximum possible value of the voltage measurement signal;

c) evaluating the comparison signal in each case before the first semiconductor element is switched on and in each case before the second semiconductor element is switched on, and detecting one of the first and second type non-zero-voltage-switching operations based on these evaluations.

2. The method as claimed in claim 1, wherein the reference value is closer to the minimum possible value than to the maximum possible value.

3. The method as claimed in claim 1, wherein step a) further comprises obtaining the voltage measurement signal from a resistive voltage divider coupled to the output of the half-bridge circuit.

4. The method as claimed in claim 1, wherein step a) further comprises obtaining the voltage measurement signal from a capacitive voltage divider coupled to the output of the half-bridge circuit.

5. A lamp ballast, comprising:

a half-bridge circuit with a first and a second semiconductor switching element which are driven on the basis of first and second drive signals, and having an output at which a first voltage is available;

a resonant circuit operably connected to the output of the half-bridge circuit, a voltage measurement circuit operably coupled to the output of the half-bridge circuit and operable to generate a voltage measurement signal which is dependent on the first voltage, the voltage measurement circuit including a capacitive voltage divider that is integrated in a semiconductor chip; and an evaluation circuit operably coupled to receive the voltage measurement signal, and configured to generate an evaluation signal based on a comparison of the voltage measurement signal with a reference value in each case before switching-on times of the first and second semiconductor switching elements, wherein the reference value is selected such that it is located asymmetrically between a minimum possible value and a maximum possible value of the voltage measurement signal.

6. The lamp ballast as claimed in claim 5, wherein the evaluation circuit is operably coupled to receive at least one of the first and second drive signals, and wherein the generation of the evaluation signal is based on the comparison at times derived from the received at least one of the first and second drive signals.

7. The lamp ballast as claimed in claim 5, wherein the evaluation circuit operably coupled to receive the first and second drive signals, and wherein the generation of the evaluation signal is based on the comparison at times derived from the received first and second drive signals.

8. The lamp ballast as claimed in claim 5, wherein the reference value is closer to the minimum possible value than the maximum possible value.

9. The lamp ballast as claimed in claim 5, wherein the evaluation circuit includes a switch, which is connected between an output of the voltage measurement circuit and a reference ground potential, the switch controlled on the basis of one of the first and second drive signals.

10. A method for detection of a non-zero-voltage switching operation of a first and a second type of a lamp ballast, comprising:

a) obtaining a voltage measurement signal representative of a voltage at an output of a half-bridge circuit of a lamp ballast, the half-bridge circuit including first and second switches, a resonant, and a first capacitance coupled in parallel with at least one of the first and second switches;

b) providing a comparison signal by comparing the voltage measurement signal with a reference value, wherein the reference value is selected such that it is located asymmetrically between a minimum possible value and a maximum possible value of the voltage measurement signal;

c) evaluating the comparison signal in each case before the first semiconductor element is switched on and in each case before the second semiconductor element is switched on, and detecting one of the first and second type non-zero-voltage-switching operations based on these evaluations.

11. The method of claim 10, further comprising:

charging the first capacitance when the second switch is turned off, and discharging the first capacitance with the first switch is turned off.

12. The method of claim 11, further comprising using a diode integral with the first switch to limit the voltage rise of the first capacitance.

13. The method of claim 10, further comprising operating the first capacitance as a snubber.

* * * * *